United States Patent [19]

Carow

[11] Patent Number: 4,899,789

[45] Date of Patent: Feb. 13, 1990

[54] METERING DEVICE FOR LIQUIDS

[76] Inventor: Robert Carow, 2216 Nish Rd., Crystal Lake, Ill. 60012

[21] Appl. No.: 25,575

[22] Filed: Mar. 13, 1987

[30] Foreign Application Priority Data

Mar. 12, 1986 [DE] Fed. Rep. of Germany ..... 3608138

[51] Int. Cl.[4] ..... B69D 37/00

[52] U.S. Cl. ..... 141/24; 222/207; 141/319; 141/310

[58] Field of Search ..... 141/1–12, 141/18–29, 319–322, 310; 222/205, 207, 209, 454

[56] References Cited

U.S. PATENT DOCUMENTS

| | | | |
|---|---|---|---|
| 2,603,211 | 7/1952 | Andreoli | 141/322 |
| 3,043,483 | 7/1962 | Yogt | 141/322 |
| 3,300,099 | 1/1967 | Marona | 222/207 |
| 3,383,018 | 5/1968 | Grimsely | 222/205 |
| 3,788,528 | 1/1974 | Ogle | 222/209 |
| 3,877,499 | 4/1975 | Fluster | 141/310 |
| 4,077,547 | 3/1978 | Donoghue | 222/207 |
| 4,106,673 | 8/1978 | Donoghue | 222/207 |
| 4,474,312 | 10/1984 | Donoghue | 222/205 |
| 4,573,506 | 3/1986 | Paoletti | 141/98 |
| 4,607,762 | 8/1986 | Zulauf et al. | 222/207 |
| 4,646,945 | 3/1987 | Steiner et al. | 222/207 |

FOREIGN PATENT DOCUMENTS

| | | | |
|---|---|---|---|
| 544455 | 8/1957 | Canada | 222/454 |
| 4593 | 2/1902 | Denmark | 141/322 |
| 0242253 | 10/1987 | European Pat. Off. | 222/207 |
| 1328639 | 4/1963 | France | 141/319 |

*Primary Examiner*—Ernest G. Cusick

*Attorney, Agent, or Firm*—Kane, Dalsimer, Sullivan, Kurucz, Levy, Eisele and Richard

[57] ABSTRACT

A metering device for liquids with a container, which has at least one elastically deformable wall section, and with a metering vessel. The container has an outlet with a withdrawal opening which, corresponding to the liquid to be measured out, is so narrow, that liquid emerges only when the deformable wall section is indented. The metering vessel can be connected detachably with the container, so that it surrounds the withdrawal opening during metering process. While the liquid is being measured out and with the container and the metering vessel in the inverted position, there is a liquid-tight connection between the metering vessel and the container. The very narrow withdrawal opening enables liquid to emerge when the deformable wall section of the container is indented, but prevents any flow of liquid after the metering process is completed and the metering vessel is removed.

13 Claims, 2 Drawing Sheets

METERING DEVICE FOR LIQUIDS

BACKGROUND OF THE INVENTION

The invention relates to a metering device for liquids, "liquids" being understood to include also pulpy media here. The metering device has a container and a metering vessel, which may consist of a transparent material. It may also have graduations, although these are not necessary for some embodiments. The container consists either as a whole of an elastically deformable material or has at least a wall section, which is elastically deformable.

Metering devices of this type are known, in which liquid can be forced from the container through a standpipe into the metering vessel. The standpipe extends from the base of the container into the metering vessel by an amount required by the specified metering. If the container (in the upright position) is compressed, liquid is conveyed into the metering vessel and, after the pressure exerted on the container is released, sucked back once again up to the height of the standpipe.

This known metering device has the following disadvantages. It is expensive due to the need to install a standpipe and due to a complicated sealing process. The use of the device is not hygienic because, at the end of the metering process, foreign objects such as dirt particles can reach the container together with the liquid, which is sucked back out of the metering vessel back into the container.

Moreover, known metering devices have at least one of the following disadvantages;

complicated manipulations are required at or with the container;

the precision leaves something to be desired;

the metering devices are expensive.

It is furthermore known that a liquid may simply be poured up to a mark into a metering vessel, especially a graduated beaker. However, the handling is complicated and the metered flow cannot be controlled.

The present invention is intended to provide a liquid metering device, which is free of the above-mentioned disadvantages and simple to operate and with which a high metering accuracy can be achieved and with which liquid cannot return to the container from the metering vessel.

SUMMARY OF THE INVENTION

During the metering process, the metering vessel remains connected liquid-tight with the container. The metering process is carried out after inverting the unit comprising container and metering vessel, so that the container is at the top and the metering vessel at the base. Metering in this position is made possible by the very narrow withdrawal opening, which permits liquid to escape only when the deformable wall section of the container is indented. At the end of the metering process, the upright metering vessel is removed from the inverted container. Because of the narrowness of the withdrawal opening, liquid cannot escape from the container, unless further pressure is exerted on the container. During the metering process, no liquid can be sucked back into the container, not even when the container expands once again, because the liquid level in the metering vessel is separated from the withdrawal opening by an air gap.

As a rule, no special measures are required to vent the container since, when the pressure is released, air is aspirated into the container either from the metering vessel or, after removal of the metering vessel, from the surrounding space.

With regard to another feature of the invention, the container, while being transported, can be shut off by a sealing cap or some other seal, so that liquid cannot emerge, even when pressure is exerted on the container. Moreover, the metering vessel can be mounted on the container in the position intended for the metering process even while the container is being transported.

Another feature of the invention is that a container can be permanently set down in a position suitable for the metering process, so that, whenever the need arises, only the metering vessel has to be moved.

Still another feature of the invention is that the container itself can be so designed, that is can be set up in its own base in a metering position and that there is sufficient space above a support, on which the container is resting, for slipping on and for removing the metering vessel.

Another feature of the invention is that the handling during the metering process can be simplified owing to the fact that, through exerting a pressure once on the elastically deformable section of wall, only a desired portion (metered amount) of the liquid emerges, this being adequately precise, for example, in the case of detergents or liquid washing agents, for which no high demands are made with regard to the accuracy of the metering process, whereas a simplified handling is very desirable.

According to the invention very accurate metering is made possible or facilitated owing to the fact that air can emerge as the metering vessel is filled. Such a metering procedure is if particular interest for pharmaceutical purposes. Liquids can be metered out with high accuracy in amounts of, for example, 0.5 or 1 mL. By these means, the tedious counting of drops or metering with a pipette becomes superfluous.

While a reducer, which has a narrow withdrawal opening, can be accommodated at the container itself or in its opening, the withdrawal opening can instead be provided according to claim 8 in the base of a metering vessel, which can be slipped on or screwed on the opening of the container and has a removable lid, which is closed during the metering process and opened for emptying the metering vessel.

In another embodiment of the invention, a metering device can be provided, which finds application preferably in the pharmaceutical industry and for which especially a dome-shaped metering vessel can be screwed over a cone-shaped construction onto the opening of a container, generally, a medicine bottle. During the metering process, the space remaining between the metering vessel and the construction is filled completely, while all the air escapes from this space. Compared to other possibilities, such as dropper inserts, only very little capital expenditure is required here.

DESCRIPTION OF THE PREFERRED EMBODIMENTS

Figure 1:
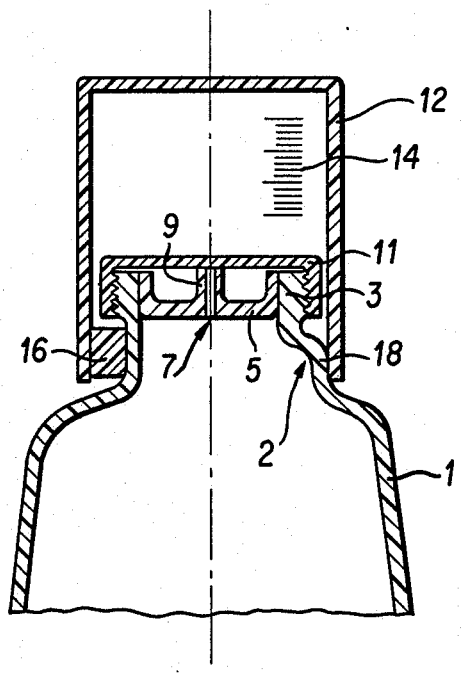
FIG. 1 shows in cross section the upper portion of a bottle with a metering vessel, which can be slipped on, a variation of the portrayal on the left being shown on the right of an axis of symmetry.

As shown in FIG. 1, a container 1 in the form of a bottle has an opening 2 with a screw thread 3, which accommodates a reducer 5. Within the reducing socket, a withdrawal opening 7 is provided, which partly ends in a connecting sleeve 9 of the reducing socket. The opening 2 can be closed off by a screw cap 11, which is of importance only for transporting purposes and is removed before the metering operation.

The metering vessel 12 has the shape of a beaker here, which consists of a transparent plastic material and is provided with a metering scale 14. The metering vessel can be slipped on under some tensions. In a first variation, which is shown in the left part of FIG. 1, the opening 2 is surrounded by a plastic ring 16, which is, for example, shrunk on and has an external diameter, which is larger than that of the screw cap 11. For the variation shown in the right part of FIG. 1, the container 1 has an annular ring 18, which fulfills the same purpose as the ring 16.

Before use, the screw cap 11 is removed and the metering vessel is slipped on once again. For metering purposes, the container, together with the metering vessel 12, is inverted. The container is either completely elastic or has at least an elastically deformable wall section. If pressure is exerted on the container or the wall section, liquid emerges from the withdrawal opening 9 and is filled into the metering vessel up to the desired mark of the metering scale 14. As soon as the pressure is released, air, which is still in the metering vessel above the level of the liquid, is sucked into the container. It replaces the volume of liquid that has been removed. The withdrawal opening 7, appropriate for the liquid to be metered, is so narrow, that liquid cannot flow out by itself. The metering vessel, together with its contents, can now be pulled off from the downwards facing opening of the container. A suitable choice of dimensions and materials ensures that the metering vessel, even when filled with liquid, still remains securely suspended at the container opening, yet can be pulled off with a reasonable expenditure of force.

Instead of with a screw cap, the container can also be closed off in a different manner for transporting purposes, for example, by a stopper, which is placed in the withdrawal opening, by a cap, which is slipped on the connecting sleeve 9 or by a sealing disk, which is glued to the underside of the reducing socket, that is, to the side facing the interior of the bottle. All of these parts serve to make the transporting of the container safe and are removed before the metering operation.

If it is desirable to have the air escape to the outside while the metering vessel is being filled, provisions can be made so that the air can pass between the edge of the metering vessel 12 and the ring 16 or the annular ring 18, for example, by providing grooves at the edge of the inner wall of the metering vessel approximately parallel to the axis of said vessel. It is not necessary that this connection be liquid-tight, since the metering vessel with its contents does have to be removed, while the opening of container 1 is inverted downwards. Then, however, there is no danger that liquid can escape at the edge of the metering vessel.

VARIATION OF THE FIRST EXAMPLE OF THE OPERATION

The container is shaped (for example, it has a relatively broad concentric shoulder) so that it can be placed with the opening facing downwards on a stand, the opening of the container being at such a distance from the base, on which the stand is resting, that the metering vessel can be slipped on and taken off again without difficulty. The metering process is simplified owing to the fact that the container does not have to be turned upside down and upright once again every time.

Figure 2:
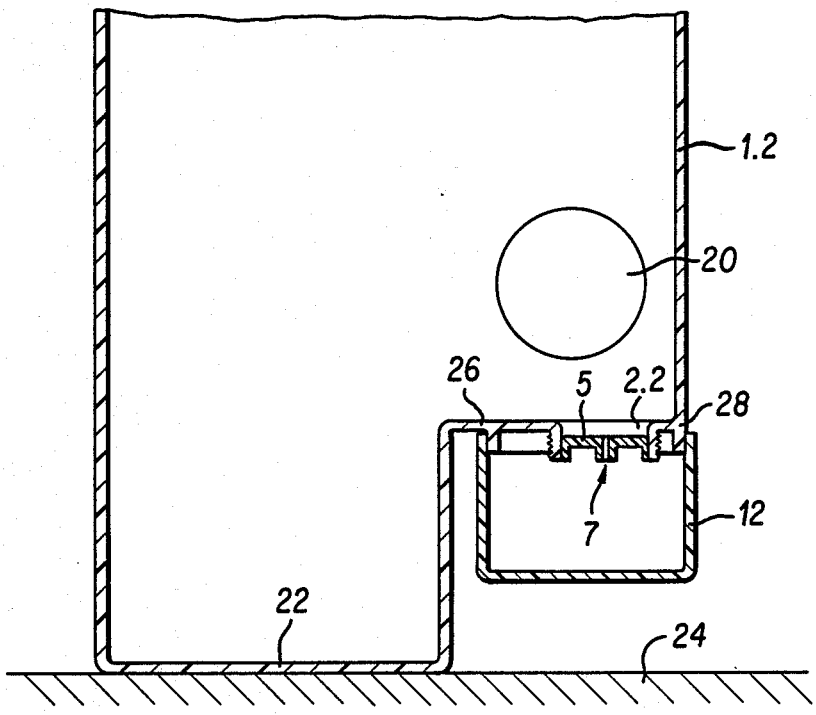
FIG. 2 shows a cross section of a container with a metering vessel, which can be slipped on from below.

FIG. 2 shows a cross section of a relatively large plastic container 1.2, which either is elastically deformable as a whole or is relatively rigid and has an elastically deformable wall section 20. The container has a base 22 or individual, integrally molded legs, with which it can be placed on a support 24. Its opening 2.2 is provided in a part 26 of the wall, which is above the horizontal elongation of the base, that is, above the support 24, and, moreover, by such a distance, that the metering vessel 12 can be slipped on and taken off conveniently. Here also, a reducing socket 5 with a withdrawal opening 7 is provided. The metering vessel 12 can be slipped onto an integrally molded ring 28, on which it is held with a tension adequate for this purpose. The metering process is carried out by exerting pressure on the wall of the container, especially on section 20 of the wall. Preferably, the container is so narrow in the region of wall section 20, that it can be grasped with one hand. The metering process proceeds in the manner described above.

The metering vessel once again may be provided with a metering scale. With such large containers, which are to be used, for example, for detergents or liquid washing agents, where high accuracy in metering is not as important, the metering can also be carried out in such a way, that a single indentation of the elastic wall section 20 leads to the delivery of the desired amount. For this purpose, the wall section preferably is constructed so that it arches to the outside in the state of rest and, in contrast to the rest of the wall of the container, is relatively easily deformable. The dimensions of the wall sections are such that the desired amount is delivered by a single indentation. If one wall section is not sufficient for this purpose, two such wall sections may also be provided on opposite sides of the container wall. While the container is being transported, the opening 2.2 may once again be closed off by a (not shown here) screw cap.

Figure 3:
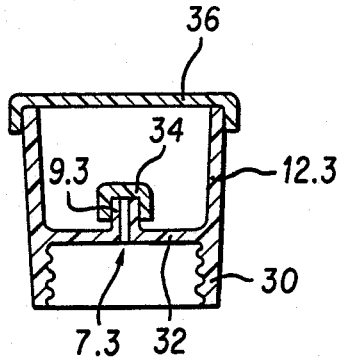
FIG. 3 shows a cross section of a metering vessel, which can be screwed onto the opening of a container.

FIG. 3 shows a metering vessel 12.3, especially one of plastic, which is equipped in one piece with a screw cap 30 for a container opening. The metering vessel has a base 32 with a withdrawal opening 7.3, which is partially within a connecting sleeve 9.3. During transport, the connecting socket can be closed off by a slip-on cap 34. The metering vessel can be closed off by a lid 36, which is slipped on under some tension.

When it is to be used, the metering vessel is screwed with the help of its screw cap 30 onto the opening of a container. The metering process is carried out in the manner described for the first example of the operation. In the inverted position, the metering vessel is sealed by its lid 36. After the container has been returned into its normal position (opening at the top), the metering vessel is unscrewed, the lid 36 is removed and the contents are poured out.

Figure 4:
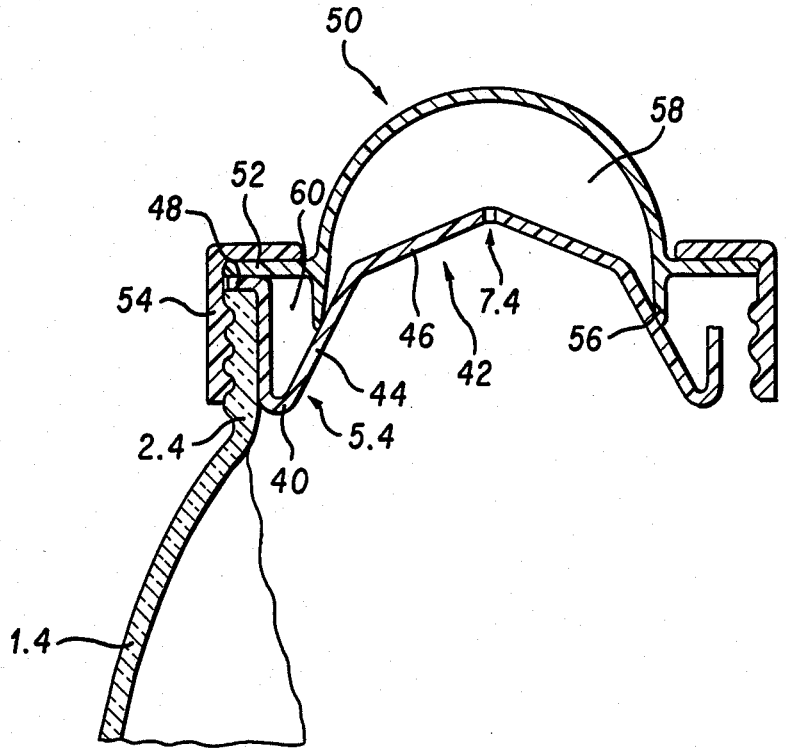
FIG. 4 a partial cross section of a dome-shaped metering vessel at the opening of a bottle.

This example of the operation is intended especially for measuring out pharmaceutical liquids. The container 1.4 normally is a bottle, in the opening 2.4 of which a beaker-like plastic reducing socket 5.4 is accommodated. From the lower edge 40 of said reducing socket, a cone-shaped formation 42 extends upwards (in the position shown in FIG. 4). At the lower end, it has a relatively steep, truncated conical section 44, which changes over into a conical section 46 of lesser slope. At the peak of the conical section, which protrudes somewhat above the bottle opening, there is the narrow withdrawal opening 7.4. The reducing socket 5.4 is seated with an exterior flange 48 on the edge of the opening 2.4.

A transparent, dome-shaped formation (metering dome 50) of polyethylene with an exterior flange 52, which is rigidly mounted in a perforated screw cap 54, is used as metering vessel here. The a metering dome has a downwards extending, thin, elastically deformable projection 56, which lies against the outer wall of the truncated conical section 44 so as to form a seal. This arrangement results, on the one hand, in a metering space 58 between the metering dome 50 and the conical formation 42 and, on the other, in an annular space 60. Before the metering process, both contain air.

If the wall of the bottle is indented in the inverted position of the bottle and metering device, the metering space 58 is filled through withdrawal opening 7.4 with liquid. Said metering space is, moreover filled completely, air escaping from the metering space with elastic deformation of the projection 56 into the annular space 60. The metered liquid can be removed after the metering dome 50 has been unscrewed (inverted position).

Different amounts of liquid can be metered out by the use of metering domes of different shapes and especially of different heights.

I claim:

1. A metering device for liquids with a container, which has at least one elastically deformable wall section, and a metering vessel, characterized by the following features:

the container has a body for containing liquid, and an outlet with a withdrawal opening which, appropriate for the liquid to be metered, is so narrow, that liquid escapes only when the deformable wall section is indented, and the liquid is prevented from freely flowing out by itself by remaining securely suspended at the container opening when the withdrawal opening faces downwardly; and the metering vessel having side walls, a closed bottom and an open top and being detachably connected with the container in such a manner that the open top surrounds the withdrawal opening;

wherein a metering process is carried out when the metering vessel relative to the container is in an upright position with the open top being above the closed bottom, and only upon indentation of the at least one deformable wall section, when the selected metered amount of liquid fills the metering vessel pressure on the at least one deformable wall section is removed, upon removal of the pressure no liquid can be sucked back into the container because means are provided for maintaining separate the liquid level in the metering vessel from the withdrawal opening by an air gap, when the pressure on the at least one deformable wall is released means are provided for aspirating air into the container, at the end of the metering process means are provided for removing the upright metering vessel, in the upright position from the container, and because of the narrowness of the withdrawal opening, liquid cannot escape from the container unless further pressure is exerted on the at least one deformable wall of the container.

2. A metering device as defined in claim 1, the container has a container opening with a reducer having the withdrawal opening defined therein.

3. A metering device as defined in claim 2 wherein a screw cap extends over the container opening, the container opening has a neck with a supporting means which projects beyond the screw cap of the container opening, so that the metering vessel can be slipped on under tension over the screw cap.

4. A metering device as defined in claim 2, characterized by the following features:

(a) the withdrawal opening is provided in the reducer of the container opening, (b) the container further defines a base, and the base is provided with a cap for mounting the metering vessel on the container opening, (c) the metering vessel can be closed off by a lid.

5. A metering device as defined in claim 4, wherein a connecting sleeve, joined to said base of the metering vessel, projects into the metering vessel and surrounds the withdrawal opening, and a slip-on cap is adapted to cover and close-off the sleeve.

6. The metering device of claim 2 wherein said reducer is a reducing socket.

7. A metering device as defined in claim 1, wherein the container has an external shape, which enables it to be set up with the withdrawal opening facing downwards.

8. A metering device as defined in claim 7, wherein the container further defines a base and the withdrawal opening is disposed at such a distance above the base of the container, that there is sufficient space for slipping on and for removing the metering vessel.

9. A metering device as defined in claim 1, wherein the at least one elastically deformable wall section is arched outwards in an unindented state and has such dimensions and, such a high elasticity, in comparison to a remaining wall section of the container that a single, complete indentation of the at least one wall section allows the metering vessel being filled to a predetermined amount.

10. A metering device as defined in claim 1 wherein, when the metering vessel is slipped onto the container, the means provided for aspirating air is defined by an aspirating opening which remains at the side walls of said metering vessel, said aspirating opening permits air to escape from the metering vessel as the metering vessel is being filled.

11. A metering device as defined in claim 1, further including; said container having a container opening; a screw cap for closing off the container opening, said screw cap provided with a base and a screw cap opening in the base, said metering vessel formed as a dome which terminates in an elastic, approximately cylindrical projection, the container opening accommodates an upwardly directed, conical, beaker-shaped insert, the peak of which defines the withdrawal opening; the projection of the metering vessel is disposed so that it forms a seal with an outer wall of the insert with elastic deformation of at least one of the insert and projection.

12. A metering device as defined in claim 11, wherein within the beaker-shaped insert, an exterior of the insert and the projection of the metering vessel an annular space is formed for accommodating air, displaced from the metering vessel as the metering vessel is filled.

13. The metering device of claim 1 wherein said metering vessel is transparent.

* * * * *